US005924323A

United States Patent [19]

Godesa et al.

[11] Patent Number: 5,924,323

[45] Date of Patent: Jul. 20, 1999

[54] LEVER ARRANGEMENT TO TRANSMIT A DRIVING FORCE

[75] Inventors: Ludvik Godesa; Michael Sebekow; Adolf Wihan, all of Berlin, Germany

[73] Assignee: Siemens Aktiengesellschaft, Munich, Germany

[21] Appl. No.: 08/727,472

[22] PCT Filed: Apr. 10, 1995

[86] PCT No.: PCT/DE95/00493

§ 371 Date: Feb. 14, 1997

§ 102(e) Date: Feb. 14, 1997

[87] PCT Pub. No.: WO95/29495

PCT Pub. Date: Nov. 2, 1995

[30] Foreign Application Priority Data

Apr. 20, 1994 [DE] Germany ..... 44 16 088

[51] Int. Cl.[6] ..... G05G 17/00; H01H 5/00

[52] U.S. Cl. ..... 74/2; 200/400; 200/401

[58] Field of Search ..... 74/2; 185/40 R; 200/400, 401

[56] References Cited

U.S. PATENT DOCUMENTS 4,901,821 2/1990 Dale ..... 185/40 R
5,545,867 8/1996 Castonguay et al. ..... 74/2 X

FOREIGN PATENT DOCUMENTS 0 088 215 9/1983 European Pat. Off. .
35 42 746 6/1987 Germany .

*Primary Examiner*—Allan D. Herrman
*Attorney, Agent, or Firm*—Kenyon & Kenyon

[57] ABSTRACT

A lever arrangement for transmitting a driving force to a switch contact of a power switch has parallel bearing plates with limiting parts mounted on them to reduce the distance between the bearing plates locally to a distance suitable for guiding hinge-connected levers. Hinge pins of the levers are guided so they slide along the limiting parts. Threaded pins are riveted to one bearing plate at one end and are secured on the other bearing plate with a nut.

10 Claims, 4 Drawing Sheets

LEVER ARRANGEMENT TO TRANSMIT A DRIVING FORCE

FIELD OF THE INVENTION

The present invention relates to a lever arrangement for transmitting a driving force to a switch contact of a power switch, with a spring energy store device and a plurality of levers connected by hinge pins and arranged between the spring energy store device and the switch contact, and with parallel bearing plates that accommodate the lever arrangement between them.

BACKGROUND OF THE INVENTION

Examples of such lever arrangements are disclosed in German patent DE-A 3,542,746 and European patent EP-A 88,215. The low-voltage power switches described there are designed for a high switching capacity and therefore require a very efficient switching mechanism.

OBJECTS AND SUMMARY OF THE INVENTION

One object of the invention is to design the lever arrangement so that the weight and cost of the power switch will be within a favorable range.

This object is achieved according to this invention by mounting a parallel limiting part on each of the bearing plates with a spacer inserted in between, where the clearance between the limiting parts corresponds to a local width of the lever arrangement, and the bearing plates are connected by at least one retaining pin connected to each of the bearing plates.

These features achieve the result of a simple design of the hinges between the pairs of levers, in which guidance with practically no play is possible and nevertheless the bearing plates may have a spacing suitable to also accommodate components of the lever arrangement having a greater width. The framework consisting of the bearing plates and the limiting parts is also characterized by a high flexural strength with a relatively low weight.

It is equally advantageous in terms of strength and ease of assembly if the retaining pin is riveted rigidly at one end to the respective bearing plate and if the other end with a threaded stem passes through an orifice in the other bearing plate and is secured with a nut.

The lever joints can be simplified by designing at least one of the hinge pins so that it corresponds to the spacing between the bearing plates, and providing the limiting parts with through-holes for hinge pins.

At least one of the retaining pins can be designed as a stop to limit the path of parts of the lever arrangement. This has the advantage that the force is introduced uniformly into the bearing plates.

At least one of the retaining pins can be designed to connect both the bearing plates and the limiting parts.

A suitable thrust bearing with an especially good load-bearing capacity results from an arrangement where a stationary hinge pin of the lever arrangement rests with each end in a bearing sleeve that engages with a pin in an orifice of the respective bearing plate and engages with a collar in an orifice of the respective limiting part.

The bearing plates can also be designed as an abutment for the spring energy store device and may be arranged with a distance between them that corresponds to the diameter of the spring energy store device.

Even for the strong forces that occur in releasing the spring energy store device, the framework can be set up by arranging two pairs of end faces opposite a pressure plate of the spring energy store device as the end stop, where one pair is formed by the limiting parts and the second pair is formed by two guide partitions attached to the bearing plate.

BRIEF DESCRIPTION OF THE DRAWINGS

The features of the invention described above and additional features are described in greater detail below with respect to the embodiment illustrated in the drawings, of which.

DETAILED DESCRIPTION

Figure 1:
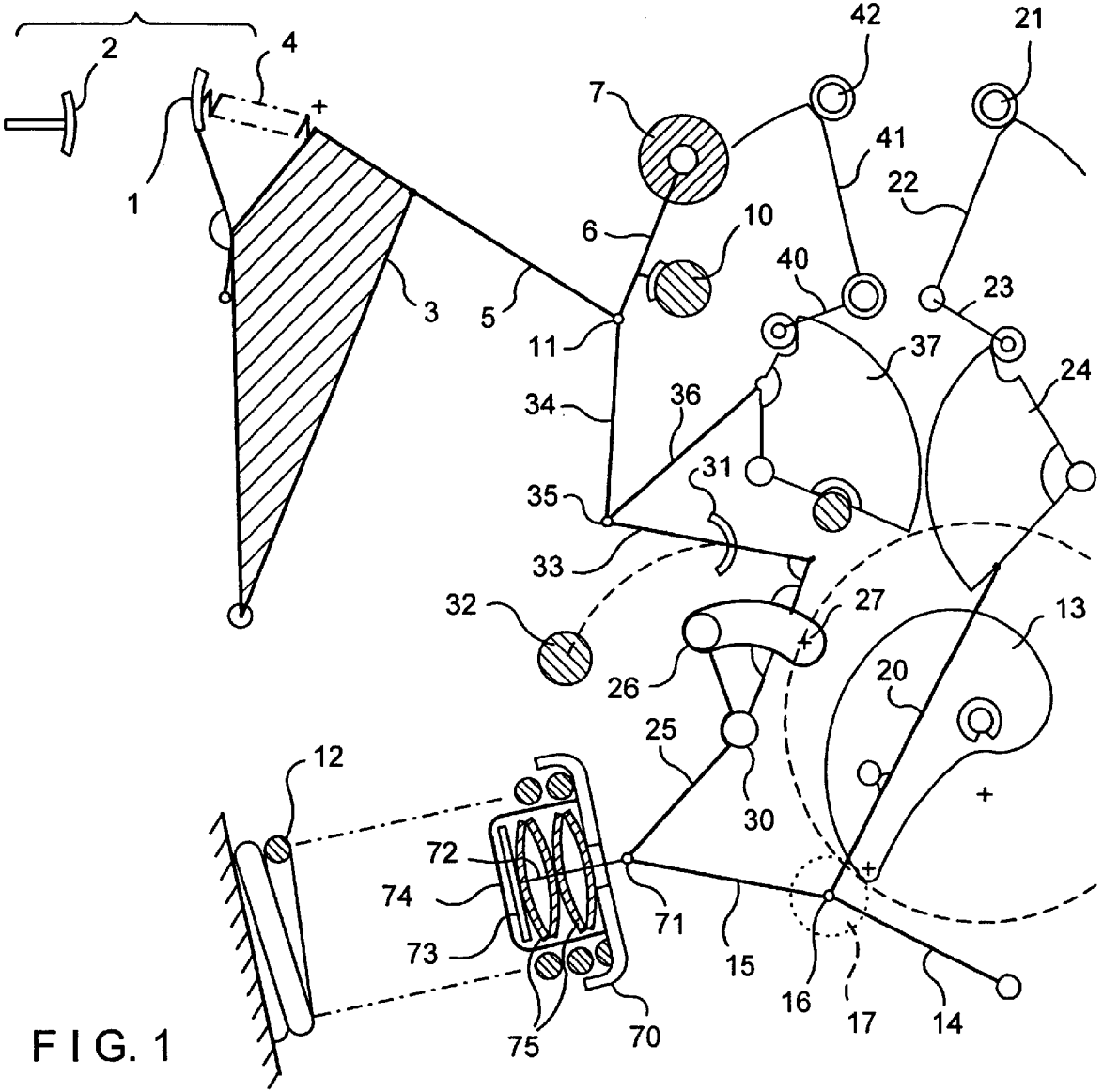
FIG. 1 is a schematic diagram of a lever arrangement for a low-voltage power switch.

The lever arrangement shown schematically in FIG. 1 serves to operate a switch contact arrangement having a movable contact lever 1 and a stationary counter-contact 2. Movable contact lever 1 is hinge-connected to a lever support 3 that is mounted so it can pivot and is provided with a contact force spring 4. Two toggle levers 5 and 6 provide a hinge connection for the lever support 3 to an operating shaft 7 that is provided jointly for a plurality of poles of a power switch. According to the "off" position of lever support 3 illustrated here, the toggle levers 5 and 6 are shown in a bent position where toggle lever 6 is resting against stop 10.

A hinged joint 11 between toggle levers 5 and 6 is acted on by other levers that are common to all the poles of a power switch and have the function of providing the total operating energy required. For this purpose, a spring energy store device 12 designed as a helical compression spring is provided and abuts against surface 12A. Spring energy store device 12 is loaded by means of a cam plate 13 in combination with toggle levers 14 and 15 whose connecting joint 16 is acted on by cam plate 13 by means of a roller 17 (shown with dotted lines). In the position according to FIG. 1, toggle levers 14 and 15 are almost in their fully extended position, so spring energy store device 12 is loaded and ready for use. A supporting lever 20 that acts on hinged joint 16 is supported by means of a two-step contact latch, which includes a contact half-shaft 21, a pivotable main contact latch 22, a roller lever 23 connected to main contact latch 22 and an auxiliary latch 24 connected to supporting lever 20.

Another lever system positioned approximately parallel to the above-mentioned parts connects spring energy store device 12 to hinged joint 11 between toggle levers 5 and 6. This lever system also includes a driving lever 25 connected to spring energy store device 12 and having a driver 26 and a free-wheeling link 27 which, like driving lever 25, can be pivoted about a stationary bearing pin 30. Free-wheeling link 27 supports a stop part 31 that works together with a stationary stop 32. Free-wheeling link 27 is connected to hinged joint 11 by way of two other hinged joints 33 and 34, with joint 35 between toggle levers 33 and 34 being supported on an auxiliary tripping latch 37 via supporting lever 36. In the position of the lever system shown here, the auxiliary tripping latch is in contact with a roller lever 40 of a main tripping latch 41 that is held by a tripping half-shaft 42.

Figure 2A:
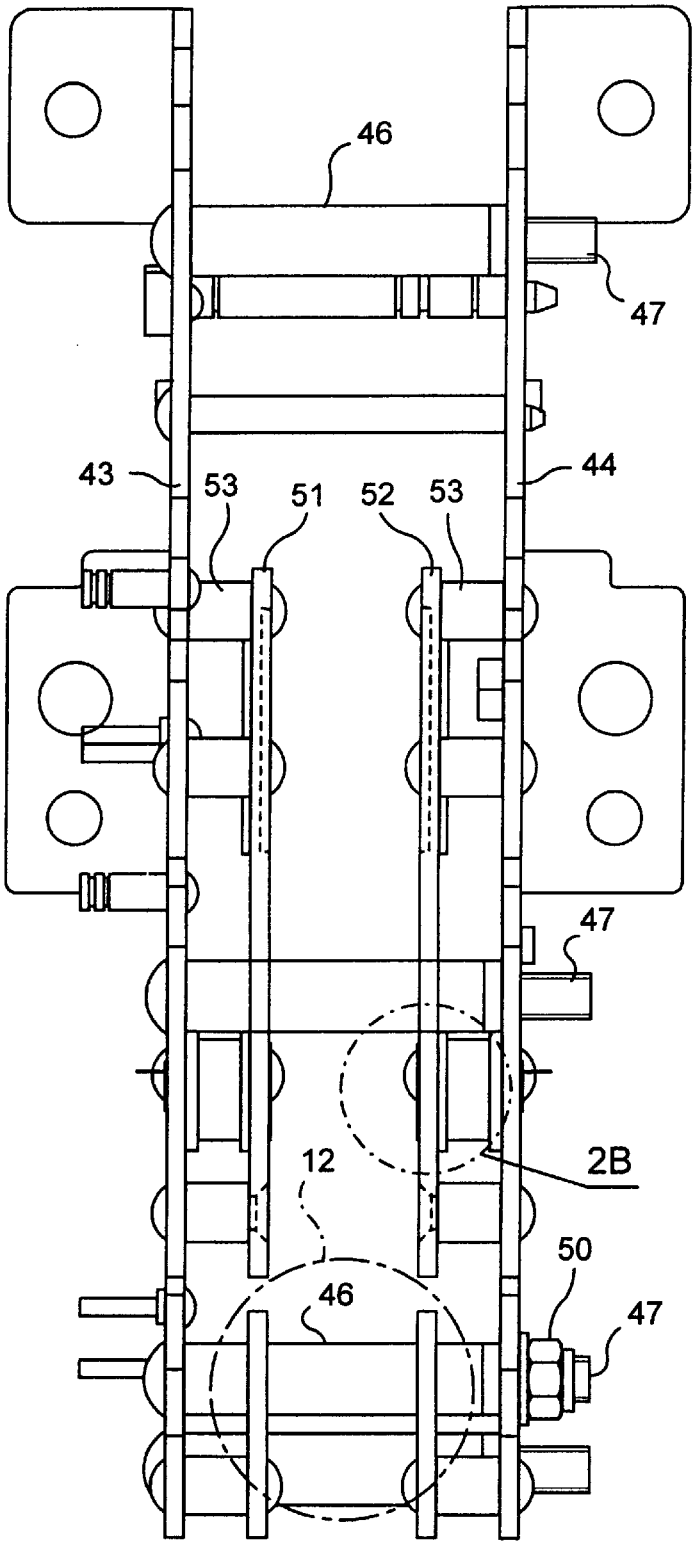
FIG. 2A is a front view of an arrangement of bearing plates and limiting parts to accommodate the lever arrangement.
Figure 3:
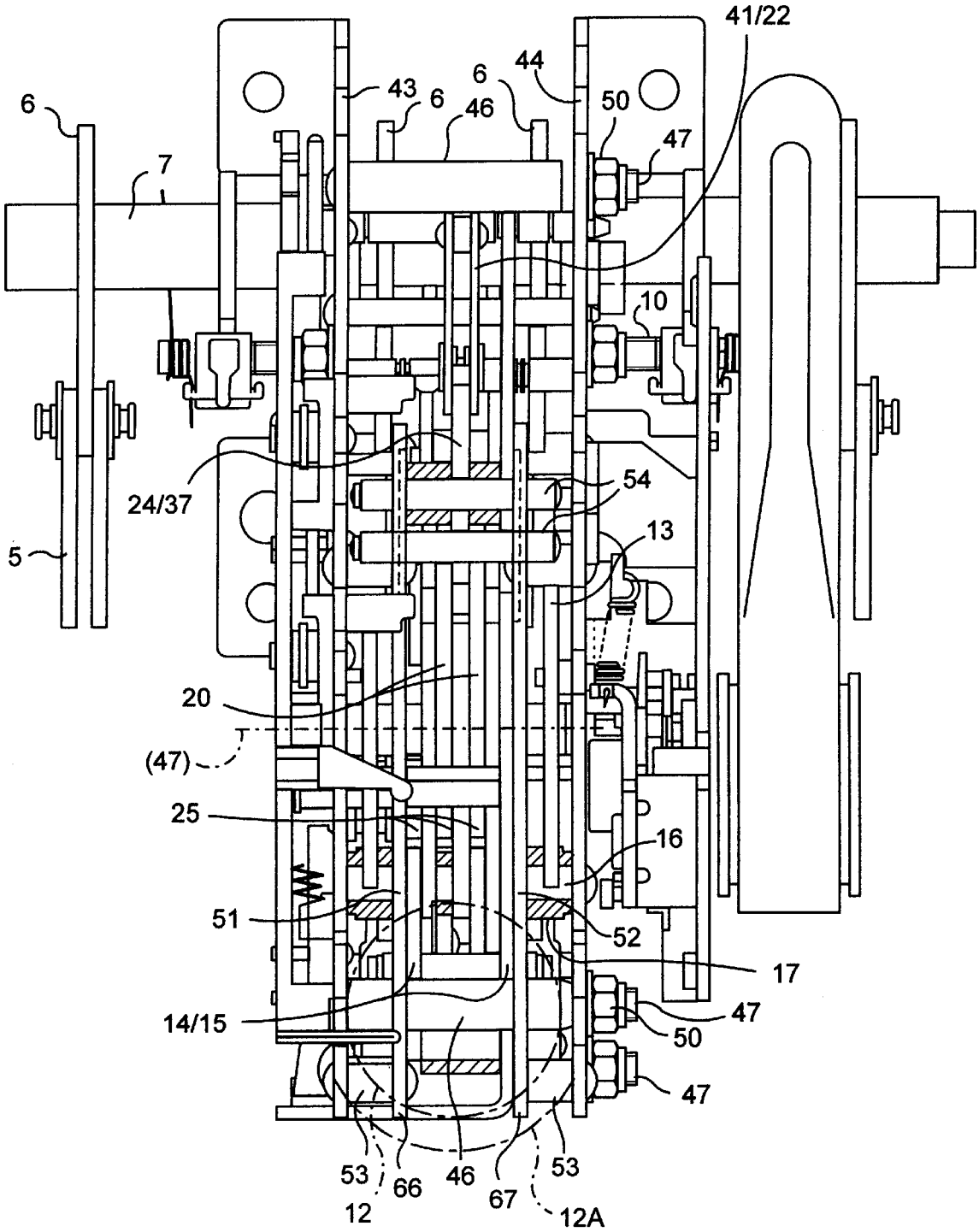
FIG. 3 is a front view of an arrangement corresponding to that in FIG. 2A, with bearing plates and limiting parts shown together with a lever arrangement.

FIG. 2A illustrates an example of a framework that can accommodate the lever arrangement illustrated in FIG. 1. The framework has two parallel bearing plates 43 and 44 at right angles to operating shaft 7 (FIGS. 1 and 3). The distance between bearing plates 43 and 44 is such that spring energy store device 12 can be accommodated between them. Bearing plates 43 and 44 can be designed to serve as abutments for the spring energy store device 12, and bearing plates 43 and 44 may be arranged with a distance between them that corresponds to the diameter of the spring energy storage device 12. At several locations on bearing plates 43 and 44 there are mounting elements (also referred to as retaining pins) 46, each of which consists of a spacer pin riveted to bearing plate 43 and having a threaded stem 47 at the end. This arrangement in combination with a nut 50 on each element yields a bending-resistant, i.e., rigid, connection of bearing plates 43 and 44.

Limiting parts 51 and 52 are attached by means of a plurality of spacers 53 to bearing plates 43 and 44 above spring energy store device 12. This creates a lateral guidance with little play for the entire lever arrangement. At the same time, this guidance is especially stable with respect to lateral forces because limiting parts 51 and 52 that are each riveted to one of the bearing plates provide a considerable reinforcement of the framework. At least one of the mounting elements 46 can be designed to connect both the bearing plates 43 and 44 and the limiting parts 51 and 52.

Figure 4:
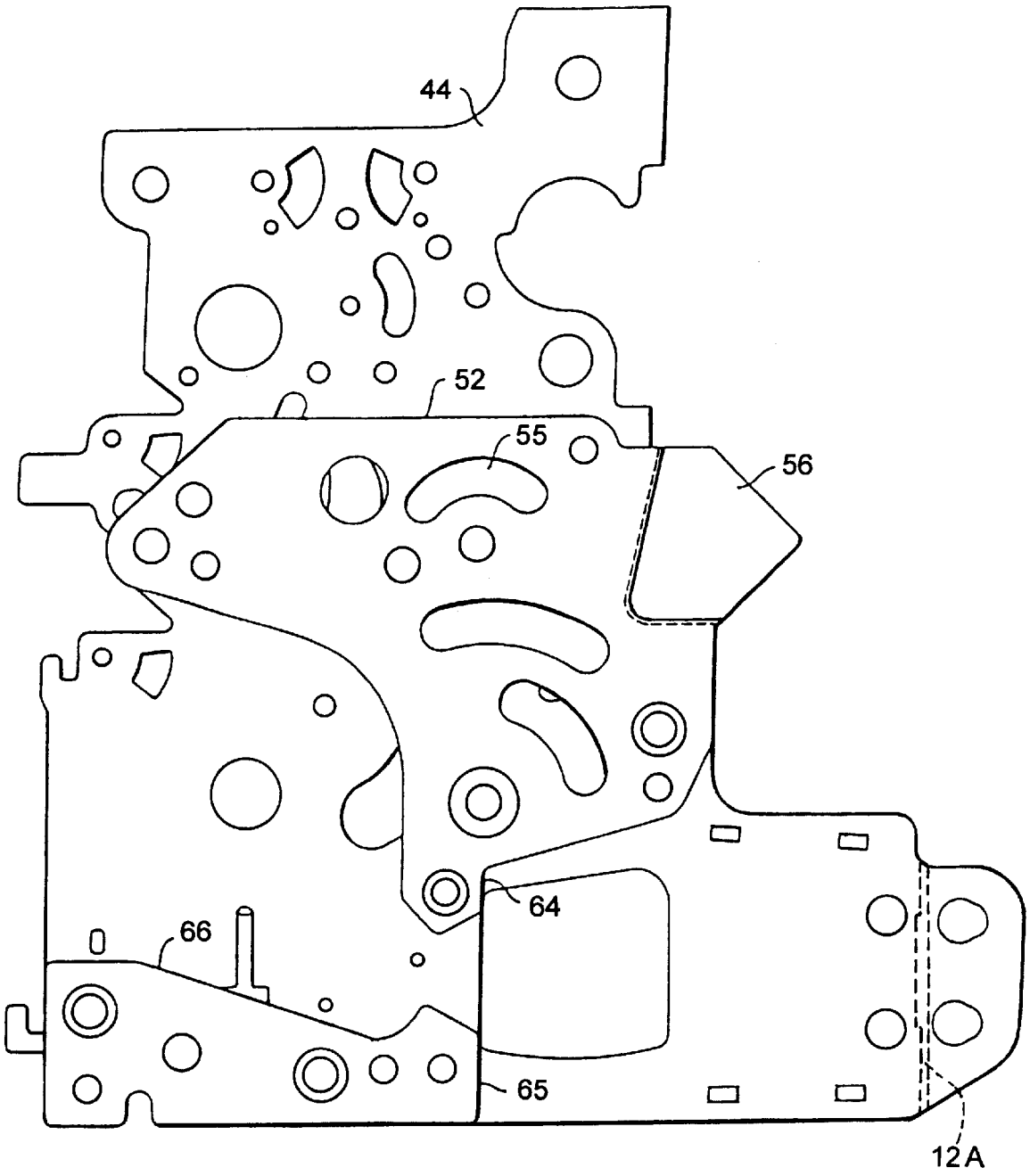
FIG. 4 is a side view of a single bearing plate with a limiting part riveted to it and with a guide partition.

Hinge pins 54 (FIG. 3) which form the hinges between toggle lever 33 and free-wheeling link 27, for example, and between supporting lever 36 and auxiliary tripping latch 37 (FIG. 1) pass through orifices 55 (FIG. 4) in limiting parts 51 and 52 and are designed so that they are guided on bearing plates 43 and 44. As FIG. 4 shows, a section of limiting part 52 extends beyond the contour of bearing plate 44. In this area, limiting part 52 and the other limiting part 51 that is not visible in FIG. 4 are provided with an debossed section 56 that serves as a guide face for a shorter hinge pin. An appropriate projecting length of the hinge pin over the lever that is guided in this area is made possible by debossed section 56. Such a shorter hinge pin can be provided for hinged joint 11, for example (FIG. 1).

Figure 2B:
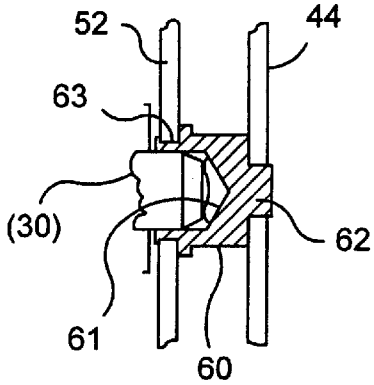
FIG. 2B is a magnification of a portion of the view shown in FIG. 2A.

The magnified view presented in FIG. 2B shows how a stationary hinge pin of the lever arrangement, which may be bearing pin 30 in FIG. 1, is supported in the framework. This is accomplished by means of two bearing sleeves 60 (also referred to as bushings) having a blind hole 61 for a bearing pin. Bushings 60 are riveted to bearing plates 43 and 44 as well as limiting parts 51 and 52. For this purpose, each bearing sleeve 60 has a pin 62 and a collar 63. Each bearing sleeve 60 thus engages with its corresponding pin 62 in an orifice of a corresponding one of the bearing plates 43 and 44. Further, each bearing sleeve 60 engages with its corresponding collar 63 in an orifice of a corresponding one of the limiting parts 51 and 52.

As mentioned previously, spring energy store device 12 is accommodated between bearing plates 43 and 44 in the lower area of the framework. A special design assures that the considerable forces occurring in this area upon the release of spring energy store device 12 can be absorbed without damage to the framework. For this purpose, limiting parts 51 and 52 according to FIG. 4 are each provided with a stop face 64 while another stop face 65 is designed on each guide partition 66 and 67 mounted so that they are approximately aligned with limiting parts 51 and 52 by means of additional spacers 53 (FIG. 3). Guide partitions 66 and 67 accommodate toggle levers 14 and 15 between them (FIG. 1) and form a stop for hinge 16 of roller 17. A pressure plate 70 that rests against all four stop faces mentioned above is indicated schematically in FIG. 1.

Another measure in the area of spring energy store device 12 which is also illustrated in FIG. 1 reduces the stress on stop faces 64 and 65. This is accomplished by uncoupling the entire lever arrangement from spring energy store device 12 to a certain extent and thus preventing the entire moving mass of the lever arrangement from acting on the stop faces. Therefore, a push-rod 72 that extends into the inside of spring energy store device 12 where it supports end piece 73 is connected to a hinge 71 that is mounted on pressure plate 70 and acted upon toggle lever 15 and driving lever 25. End piece 73 is opposite a pot-shaped stop 74 that is connected to pressure plate 70 and thus ensures the transmission of forces between these levers and spring energy store device 12. At the opposite end, however, end piece 73 is supported on the inside of pressure plate 70 by way of spring elements 75. These spring elements are designed as pairs of disc springs.

As this shows, the arrangement of spring elements 75 makes it possible for joint 71 to continue moving to a certain extent under the influence of the kinetic energy of the levers connected to hinge 71 when pressure plate 70 is already in contact with stop faces 64 and 65. This reduces the stress on the stop faces and the entire framework as well as all the hinge pins and bearing pins.

We claim:

1. A lever arrangement for transmitting a driving force to a contact lever of a power switch, comprising:

a spring energy storage device;

a plurality of levers connected by hinge pins and arranged between the spring energy storage device and the contact lever;

parallel bearing plates accommodating the levers between said plates;

a parallel limiting part mounted on each of the bearing plates with a spacer between each limiting part and the bearing plate on which it is mounted, wherein the limiting parts define a clearance therebetween corresponding to a local width of the lever arrangement, and the bearing plates are connected to each other by at least one retaining pin rigidly connected to each of the bearing plates.

2. The lever arrangement of claim 1, wherein one end of the retaining pin is rigidly riveted to one of the bearing plates, and an opposite end of the retaining pin includes a threaded stem passing through an orifice in the other bearing plate and secured by a nut.

3. The lever arrangement of claim 1, wherein at least one of the hinge pins is configured to correspond to the distance between the bearing plates, and the limiting parts are provided with through-holes for receiving said hinge pin.

4. The lever arrangement of claim 1, wherein the at least one retaining pin is so dimensioned that the retaining pin limits the path of parts of the lever arrangement.

5. The lever arrangement of claim 4, wherein the at least one retaining pin connects the bearing plates to each other and the limiting parts to each other.

6. The lever arrangement of claim 1, further comprising a stationary hinge pin having ends positioned in bearing sleeves, said bearing sleeves each having a pin engaging an orifice in one of the bearing plates and having a collar engaging an orifice in one of the limiting parts.

7. The lever arrangement of claim 1, wherein the bearing plates comprise abutments for the spring energy storage device, said bearing plates being arranged with a distance therebetween corresponding to the diameter of the spring energy storage device.

8. The lever arrangement of claim 7, further comprising two pairs of stop faces arranged opposite the spring energy storage device as a final stop, with one pair formed by the limiting parts and the other pair formed by two guide partitions mounted on the bearing plate.

9. The lever arrangement of claim 1, further comprising a pressure plate and a hinge on a movable end of the spring energy storage device for connecting the spring energy storage device to a toggle lever that supplies stored energy to a driving lever that transmits the stored energy in the direction of the contact lever, said lever arrangement further comprising a push-rod extending inside the spring energy storage device and connected to the hinge, said push-rod including an end piece opposite a stop rigidly connected to the pressure plate and also opposite the pressure plate, wherein a spring element is positioned between the stop and the pressure plate, the spring element having a high spring constant relative to the spring energy storage device.

10. The lever arrangement of claim 9, wherein the spring element comprises pairs of disc springs, and wherein the stop is pot shaped and is rigidly connected to the pressure plate at an edge thereof.

* * * * *